United States Patent [19]

Johnson

[11] Patent Number: 4,582,206

[45] Date of Patent: Apr. 15, 1986

[54] MOBILE AERIAL HOIST

[76] Inventor: Leonard L. Johnson, 2626 Simon Rd., Huntertown, Ind. 46748

[21] Appl. No.: 521,048

[22] Filed: Aug. 8, 1983

[51] Int. Cl.[4] ..... B66C 23/04

[52] U.S. Cl. ..... 212/264; 212/229; 212/231; 212/233; 212/261; 212/263; 212/267; 182/2; 52/730

[58] Field of Search ..... 182/2; 212/160, 211, 212/227, 230–232, 234, 237–238, 241, 244, 255, 260–261, 263–265, 266

[56] References Cited

U.S. PATENT DOCUMENTS

| | | | |
|---|---|---|---|
| 3,146,853 | 9/1964 | Eckels | 182/2 |
| 3,467,217 | 9/1969 | Zwight | 182/2 |
| 3,590,948 | 7/1971 | Milner | 182/2 |
| 3,828,941 | 8/1974 | Coutinho | 212/264 |
| 3,937,340 | 2/1976 | Grove | 182/2 |
| 4,310,098 | 1/1982 | Dirksen | 212/265 |
| 4,314,622 | 2/1982 | Lindquist | 182/2 |
| 4,427,121 | 1/1984 | Clements | 212/231 |

FOREIGN PATENT DOCUMENTS

| | | | |
|---|---|---|---|
| 1531161 | 12/1969 | Fed. Rep. of Germany | 212/264 |

*Primary Examiner*—Trygve M. Blix
*Assistant Examiner*—R. B. Johnson

[57] ABSTRACT

A hoist for controllably lifting, holding or lowering an object from a mobile aerial device having an articulated or extendable boom supporting a man-lifting platform. The hoist has an adjustably positioned housing and positioning plate mounted to a shaft. The shaft is secured to the boom of the mobile aerial device, in proximity to the man-lifting platform. An elongated jib with sheave at one end is supported by the housing and may be linearly positioned in relation to the hoist housing. The housing may be manually positioned in relation to the positioning plate, and the positioning plate may be rotatably positioned in relation to the mobile aerial device boom by fluid control means. A rotary fluid motor is adapted to turn a drum about the hoist shaft and controllably wind or unwind a line about the drum. The line extends from the drum about a sheave rotatably secured to one end of the jib, and is of a length sufficient to extend to the object to be moved by the hoist. Where the mobile aerial device is intended to be positioned over-center, or beyond vertical, a second sheave at the jib end to receive the line when the hoist is over-center, is provided to allow over-center hoist operation. Hoist controls are intended to be mounted near the mobile aerial platform, for ease of operation, and opposing hoist control handles may extend beyond the boom profile for use in over-center applications.

8 Claims, 6 Drawing Figures

MOBILE AERIAL HOIST

FIELD OF THE INVENTION

This invention relates to material handling equipment. More particularly, to a hoist adapted for use on mobile aerial equipment having a man-lifting platform. The hoist herein disclosed, is further adapted for use with mobile aerial equipment having over-center positioning characteristics.

DESCRIPTION OF THE PRIOR ART

Mobile aerial equipment of articulated or extendable boom design have been adapted to raise and position one or more workmen in close proximity to elevated work to be performed, such as replacement of a power line transformer or the like.

Such a transformer is often heavier than a man can reasonably lift. The use of a hoist in proximity to the working platform greatly aids the worker in accomplishing his task. The use of an adjustably positioned jib extending from the hoist enables the operator to position the load in an elevated position.

The recent advent of mobile aerial equipment designed for over-center operation greatly increases the maneuverability of mobile aerial devices, enabling the operator to maneuver the working platform between elevated obstacles difficult or impossible to reach with non-over-center mobile aerial equipment.

When mobile aerial equipment is operated in an over-center condition, the upper boom is inverted along with any equipment attached to the boom. This causes jib controls, easily accessible to the worker in the platform during non-over-center operation, to be difficult or impossible to reach in over-center operation. Furthermore, the sheave end of the jib must be adapted for over-center operation, so that the hoist line will not loose contact with the sheave during over-center position.

Therefore, one object of this invention is to provide an improved hoist for use with mobile aerial equipment, or the like.

Another object is to provide an improved hoist design adapted for use in over-center mobile aerial equipment applications.

Another object is to provide fluid control of the arcuate positioning of the hoist jib, within at least a portion of the manual arcuate positioning of the jib in relation to the mobile aerial equipment boom.

Yet another object is to provide opposing control handles located in proximity to the mobile aerial equipment platform for ease of operator control regardless of boom position.

Still another object is to provide direct drive worm to worm gear with the worm gear secured directly to the winch drum, eliminating the need for auxiliary brake mechanisms for the drum and providing more positive automatic braking of the line load.

The above mentioned and other features and objects of this invention and the manner of obtaining them will become more apparent and the invention itself will be best understood by reference to the following description of an embodiment of the invention taken in conjunction with the accompanying drawings.

DESCRIPTION OF THE PREFERRED EMBODIMENT

Figure 1:
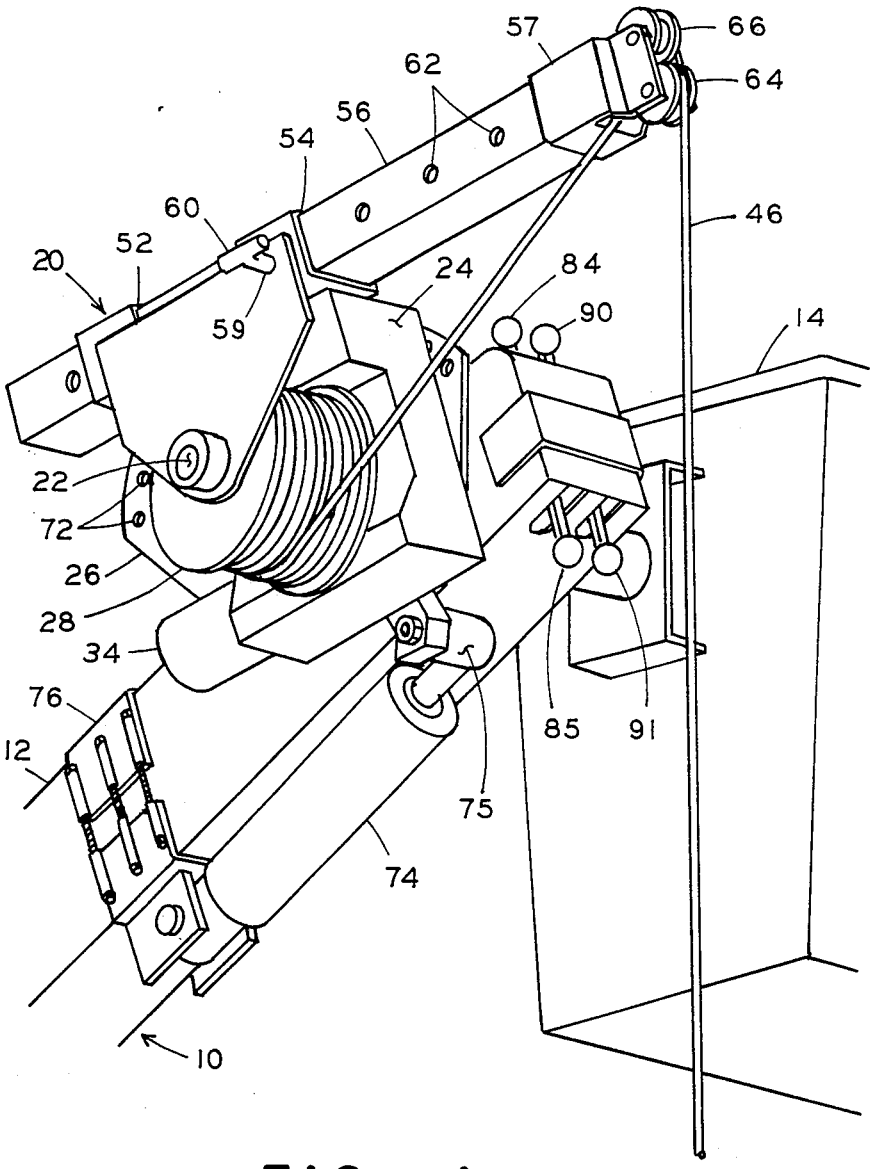
FIG. 1 is a perspective view of a mobile aerial device with a hoist positioned near the platform for ease of worker access.
Figure 3:
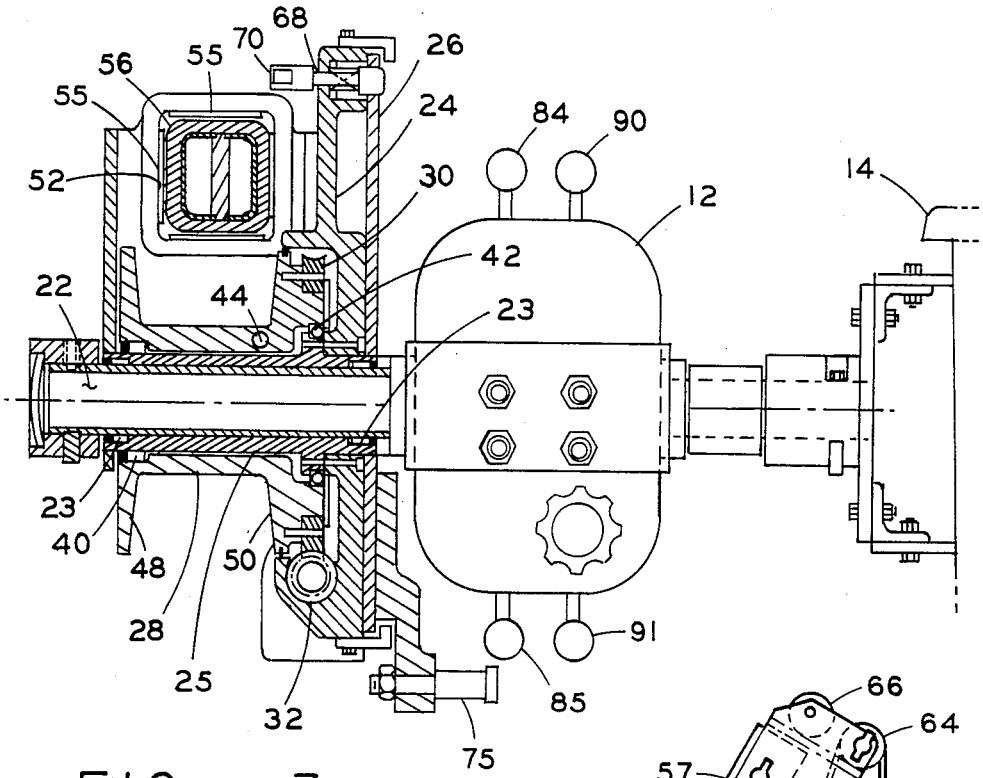
FIG. 3 is a cross sectional view of the hoist looking along lines 3—3 in FIG. 2.

The subject matter which I regard as my invention is particularly pointed out and distinctly claimed in the claims. The structure and operation of my invention, together with further objects and advantages, may be better understood from the following description given in connection with the accompanying drawings, in which:

FIGS. 1 and 3 show the preferred embodiment of a hoist adapted for use on mobile aerial equipment 10 having an articulated or extendable boom 12 adapted to support a man-lifting platform 14.

Hoist assembly 20 is adapted for securement to boom 12 about hoist mounting shaft 22 in proximity to platform 14. A hoist housing 24 is adapted for rotatable positioning about shaft 22. Bearings 23 aid rotation of housing 24 about shaft 22. A positioning plate 26 is adapted for rotatable positioning about shaft 22 in close alignment with housing 24.

Drum 28 is adapted to rotate about shaft 22. Gear 30 is securely mounted to drum 28. Gear 30 is driven by worm 32, which in turn is driven by a fluid rotating device, preferably a hydraulic motor 34. Hydraulic motor 34 is secured to housing 24 by conventional means. Motor 34 is rotatably engaged with worm 32 by coupling 36. Preferably, bearings 38 located on opposing ends of worm 32 position and align worm 32 in relation to gear 30 within housing 24.

Gear 30 and drum 28 rotate about housing extension 25 about shaft 22 aided by bearings 40, 42.

Aperture 44 provides one means to secure one end of line 46 to drum 28. Thus, as drum 28 is rotated, line 46 is wound about drum 28 between drum retaining sides 48, 50.

Hoist housing 24 is adapted with in-line apertures 52, 54 to slidably receive elongated jib 56 therethrough. Aperture 52, 54 may be lined with wear pads 55 to improve lineral positioning of jib 56 in housing 24. Housing 24 is further adapted with aperture 56 to closely receive a jib retaining pin 60 therethrough, or other conventional retaining means.

Aperture 59 is positioned in housing 24 to align with spaced apertures 62 in jib 56, so that jib 56 may be linerally positioned in relation to housing 24 by aligning apertures 59 and 62, and securing jib 56 to housing 24 by inserting jib pin 60 therethrough. The linear jib adjustment provides a plurality of apertures 62 in jib 56, providing jib extension beyond the hoist housing 24 in a preferable range of from six inches to four feet.

Figure 2:
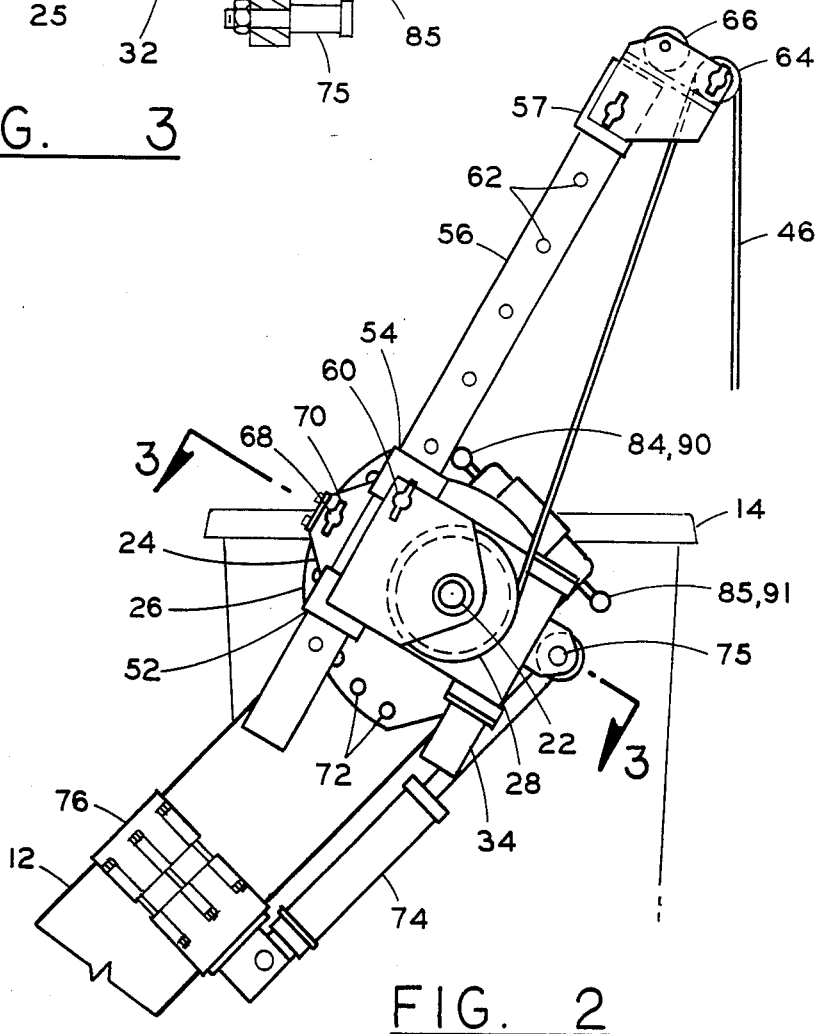
FIG. 2 is a side view of the hoist showing jib raised and extended.
Figure 5:
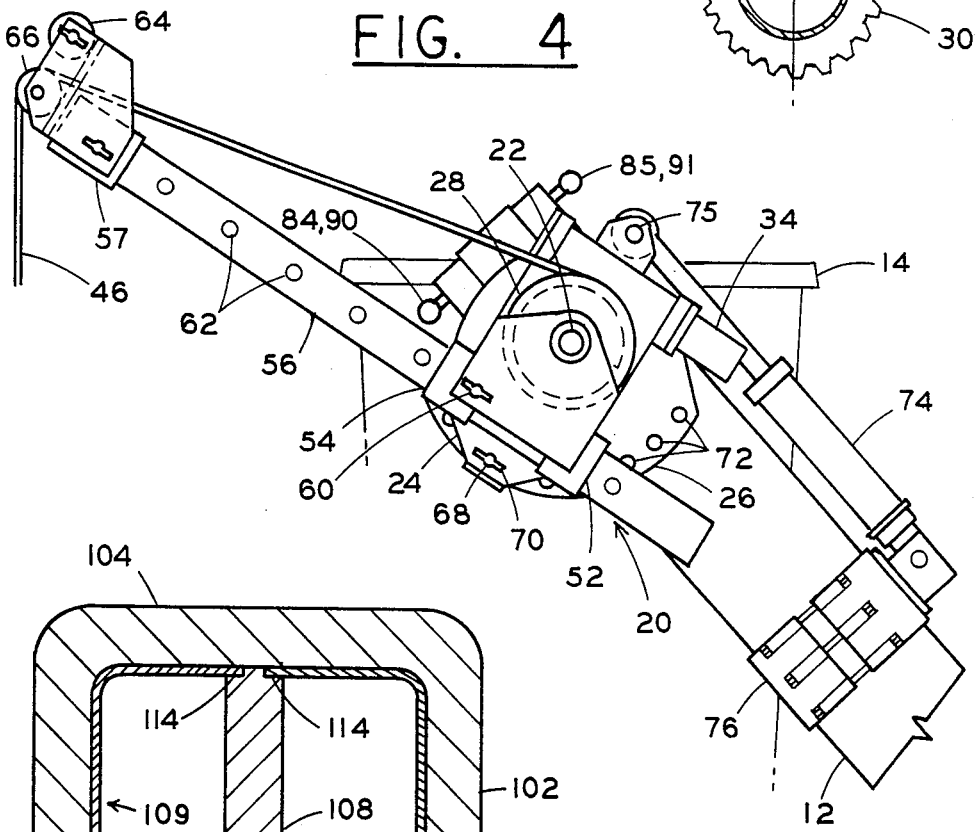
FIG. 5 shows the location of the hoist when the boom is extended to an over-center position; showing access to opposing control handles from the platform.

Referring to FIGS. 2 and 5, sheave 64 is located at one end 57 of jib 56 and is rotatably secured near the jib end 57 by conventional fastening means. Where the hoist is intended to be used when the boom is extended beyond vertical, or over-center, a second sheave 66 is positioned to alternately receive the hoist line 46 as the boom 12 is positioned beyond a vertical position.

A positioning aperture 68 is provided in housing 24 to closely receive retaining pin 70 therethrough. A plurality of spaced apertures 72 in positioning plate 26 are adapted to align with aperture 68 to provide selective rotatable securement of positioning plate 26 and housing 24 when apertures are aligned and retaining pin 70 is inserted therethrough. Other conventional retaining means may also be used.

In the preferred embodiment, the spaced apertures 72 in retaining plate 26 and housing aperture 68 are positioned to provide selective securement between the housing 24 and positioning plate 26 within a preferred adjustment range of approximately 120°.

A linerally extendable fluid device, preferably a hydraulic cylinder 74, is adapted to be pivotally secured at one end 75 to the positioning plate 26, and to the boom 12 at the opposite end, using boom clamp 76. The extendable fluid device 74 provides a range of arcuate positioning of mounting plate 24 in relation to boom 12, of at least a portion of the manual range of adjustment.

Preferably, the linear fluid device 74 is adapted to adjustably position and secure the positioning plate 26 in relation to the boom 12 within an rotatable range of 60°.

Figure 4:
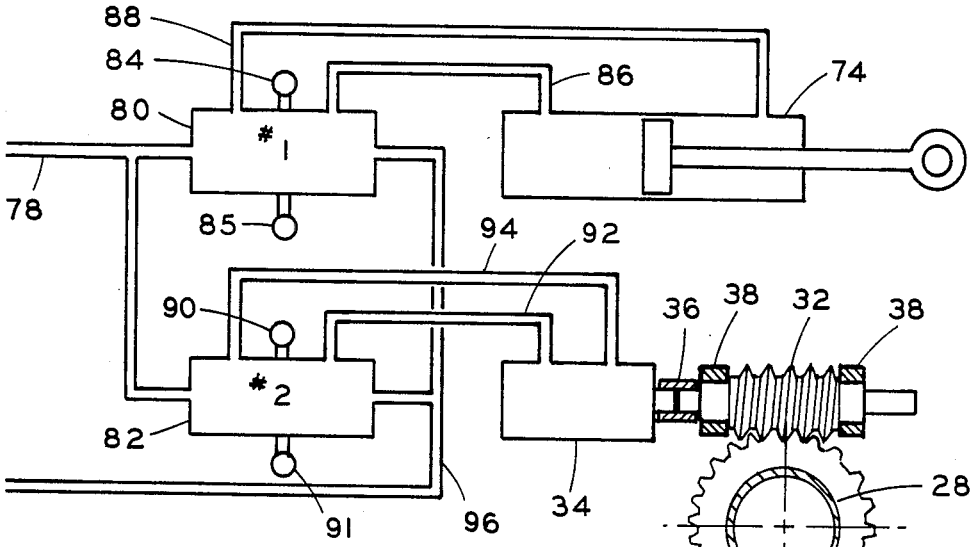
FIG. 4 is a fluid diagram of the hoist showing the preferred relation of the fluid components.

FIG. 4 shows the preferred fluid diagram wherein hydraulic pressure flows from a remote source (not shown) on the mobile aerial device 10 through fluid pressure line 78 to a first fluid control means 80 and second fluid control means 82. Preferably, fluid control means 80, 82 are hydraulic valves.

Handle 84 on #1 control 80 selectively routes fluid through lines 86 to extend, or through line 88 to retract cylinder 74 to adjustably position and secure positioning plate 26 in relation to boom 12. When handle 84 is not biased, cylinder 74 is secured in position, as fluid in lines 86, 88 is restricted from movement by #1 control 80.

Handle 90 on #2 control 82 selectively routes fluid through line 92 to rotate worm 32 to drive gear 30 to rotate drum 28. Return fluid passes thru line 94 to #2 control 82, where it passes into return line 96 to remote pumping source on mobile aerial equipment.

When handle 90 is biased in the opposite direction, pressure flows through fluid line 94 to motor 34, reversing motor rotation. Line 92 then supplies return line to #2 control 82. When handle 90 is not biased, motor 34 is secured in position, as #2 control 82 restricts movement of fluid in lines 92, 94.

FIG. 5 shows the hoist assembly 20 when the boom is extended beyond vertical, into an over-center position. Preferably, handle 84 is extended beyond the profile of the boom tip providing complimentary handle 85 for ease of operation of #1 control 80, when the boom 12 is articulated over-center for ease of worker operation from the mobile aerial platform. Preferably, handle 90 is extended beyond the profile of the boom tip providing complimentary handle 91 for ease of operation of #2 control 82, when boom 12 is articulated over-center for ease of worker operation from the mobile aerial platform. Note sheaves 64, 66 at jib 56 end to receive line 46.

Figure 6:
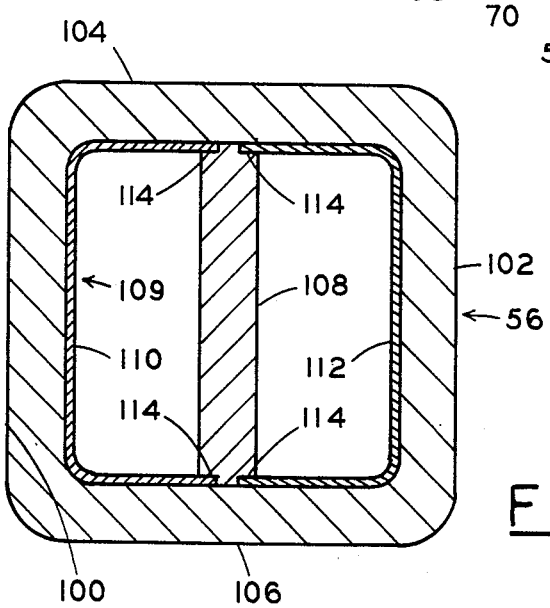
FIG. 6 is a cross section profile of the preferred fiberglass configuration of the jib.

FIG. 6 shows a cross sectional profile of the preferred fiberglass jib 56 configuration. Jib 56 is shown having sides 100, 102, top 104, and bottom 106. A vertically aligned center rib 108 extends substantially the length of the elongated jib 56. An inner core 109 is formed by fiberglass channel 110, 112 received in notches 114 in center rib 108. The inner core 109 is then externally wrapped with fiberglass to the desired strength, and externally compressed with an external clamp shell mold against the core to provide a controlled dimensional stability and finish. The central core 108 greatly improves the bending strength of the fiberglass pole, and further provides additional bearing area for jib pin 60 in apertures 62.

The disclosed hoist assembly incorporates a direct drive worm 32 to worm gear 30 drive, with the worm gear 30 attached directly to the winch drum 28. This eliminates the need for auxiliary brake mechanisms for the winch drum, and provides for more positive automatic braking of the line 46 load.

OPERATION OF THE PREFERRED INVENTION

The mobile aerial device 10 is moved to a remote elevated working location, such as electric, or telephone lines, generators or the like.

The worker enters the aerial lift platform 14 while observing the manufacturers recommended safety operating procedures and raises the boom to position platform 14 in proximity to the work to be done.

The worker removes the jib retaining pin 60, and linerally positions the end 57 of jib 56 from approximately 6 inches to four feet from the hoist housing, depending on the work to be performed. Once approximately positioned, apertures 58, 62 are aligned, and pin 60 inserted through housing and jib to secure jib 56 at the length desired.

The worker then removes pin 70, and rotatably aligns apertures 68, 72 to elevate the jib 56 to approximately the desired height in relation to the present boom 12 position. With apertures 68, 72 aligned, retaining pin 70 is then inserted therethrough.

#2 fluid control 82 is actuated by handle 90 to rotate drum 28 to extend line 46 over object to be held, raised, or lowered as required. Line 46 is then safety secured to object by conventional means.

Once jib is properly positioned, handle 90 is biased to rotate drum 28 to draw line 46 taught about drum 28, to securely hold the object.

Work may then be safely performed, such as removing the retaining bolts on a transformer, and the transformer safely lowered, by biasing handle 90 to controllably unwind line 46 from drum 28 to lower object.

Once object has been safely lowered to the ground, line 46 may be removed and secured to a replacement part, which may then be raised by moving handle 90 to controllably wind line 46 onto drum 28.

Handle 84, may be biased to rotatably raise or lower the jib under load, for ease of positioning the load. Together, handles 84 and 90 provide a worker with a means to controllably position a load from the mobile aerial platform 14 in a wide variety of operating conditions.

Therefore, while the invention has been described with reference to a particular embodiment, it is to be understood that modifications may be made without departing from the spirit of the invention or from the scope of the following claims.

What is claimed is:

1. A hoist for controllably lifting, holding or lowering objects adapted for use with a mobile aerial device having an articulated or extendable boom supporting a man-lifting platform for overcenter operation, which comprises:

(a) a hoist mounting shaft, adapted for securement to said boom in proximity to said platform;

(b) a hoist housing, adapted to be rotatably positioned about said shaft;

(c) a positioning plate, adapted to be rotatably positioned about said shaft in close alignment to said housing;

(d) a first means to manually secure said housing to said positioning plate in a plurality of rotatable positions exceeding 90 degrees of rotation about said mounting shaft in relation to said boom;

(e) a drum, adapted to be controllably rotated about said shaft;

(f) an elongated jib adapted to be linearly received and positioned in said housing;

(g) a second means to secure said jib to said housing in a plurality of linear positions;

(h) a pair of sheaves rotatably secured near one end of said jib;

(i) a load lift line, adapted to be secured at one end about said drum in a manner to extend or retract as said drum is rotated, said line extending between said sheaves in a manner to rotate about one sheave during non-overcenter operation, and about the other sheave during overcenter operation, said line adapted for connection to the object to be lifted, held or lowered;

(j) a linearly extendable fluid device pivotally mounted to said boom and said positioning plate, said linearly extendable fluid device being operative to position and secure said positioning plate in plurality of positions of less than 90 degrees of rotation about said mounting shaft in relation to said boom;

(k) a rotating fluid device, adapted to controllably rotate or secure said drum in relation to said shaft, to selectively extend or retract said line;

(l) a first fluid control means adapted to actuate said linearly extendable fluid device;

(m) a second fluid control means adapted to actuate said rotating fluid device wherein said jib may be linearly positioned and secured in relation to said housing from said man-lift platform, said jib may be manually rotatably positioned in one 90° quadrant for non-overcenter operation and in another 90° quadrant for overcenter operation, and secured in position, the second fluid control means may be actuated from said platform to rotate said drum to extend or retract said line in a manner to lift, hold or lower an object in proximity to said man-lifting platform and said linearly extendable fluid device may be actuated by said first fluid control means to raise or lower said jib;

(n) said first means to manually secure said housing to said positioning plate comprises an aperture in said housing adapted to receive a pin therethrough, a plurality of spaced apertures in said positioning plate, adapted to rotatably align and receive said pin extending through said housing, to selectively secure said housing in any one of plurality of rotatable positions for non-overcenter or overcenter operation; and (o) said first and second fluid control means includes complimentary opposing control handles extending above and below the profile of the upper boom tip for ease of access by a worker in said platform when said boom is articulated into an overcenter position.

2. The hoist of claim 1, wherein the second means to secure said jib to said housing in a pluarity of linear positions comprises: an aperature in said housing in alignment with one of a plurality of aperatures in said jib, said aperatures sized to closely receive a pin therethrough for selective securement of said jib to said housing in one of a plurality of extended and retracted positions of said jib in relation to said housing.

3. The hoist of claim 2, wherein the selected securement of said jib to said housing in one of a plurality of extended and retracted positions comprises: positioning and securing the jib end with the pair of sheaves rotatably secured thereto within a range from six inches to four feet beyond said housing.

4. The hoist of claim 1, wherein the linear extendable fluid device comprises a hydraulic cylinder.

5. The hoist of claim 1, wherein the first and second fluid control means each comprise a hydraulic valve.

6. The hoist of claim 1, wherein the rotating fluid device comprises a hydraulic motor.

7. The hoist of claim 1, wherein the fluid of the linear extendable fluid device; the first and second fluid control means; and the rotating fluid device comprises a hydraulic fluid supplied under pressure from a hydraulic pump remotely disposed upon the mobile aerial device.

8. The hoist of claim 1, wherein the drum is controllably rotated about said shaft by securing a gear to one side of said drum; rotatably securing a worm to said housing in operative engagment with said gear; and actuating said second fluid control means to controllably rotate said worm with said rotating fluid device.

* * * * *

UNITED STATES PATENT AND TRADEMARK OFFICE

CERTIFICATE OF CORRECTION

PATENT NO. : 4,582,206

DATED : April 15, 1986

INVENTOR(S) : Leonard L. Johnson

It is certified that error appears in the above-identified patent and that said Letters Patent is hereby corrected as shown below:

On the title page insert:

-- /73/ Assignee: Teco, Inc., Fort Wayne, Indiana --.

Signed and Sealed this

*Twelfth* Day of *August 1986*

[SEAL]

*Attest:*

DONALD J. QUIGG

*Attesting Officer*

*Commissioner of Patents and Trademarks*